US005140307A

United States Patent [19]

Rebetez et al.

[11] Patent Number: 5,140,307

[45] Date of Patent: Aug. 18, 1992

[54] ARRANGEMENT FOR TIMING MOVING OBJECTS

[75] Inventors: Roland Rebetez, Rossemaison; Jean-Pierre Voillat, Bassecourt, both of Switzerland

[73] Assignee: Omega Electronics S.A., Bienne, Switzerland

[21] Appl. No.: 631,994

[22] Filed: Dec. 21, 1990

[30] Foreign Application Priority Data

Dec. 25, 1989 [FR] France ..... 89 17295

[51] Int. Cl.[5] ..... G08B 1/08; G08B 23/00

[52] U.S. Cl. ..... 340/539; 340/323 R; 340/941; 340/988; 273/86 R; 455/54.1; 364/410

[58] Field of Search ..... 340/539, 531, 323 R, 340/941, 988; 364/410; 273/86 R; 455/54, 56, 99

[56] References Cited

U.S. PATENT DOCUMENTS

| | | | |
|---|---|---|---|
| 3,795,907 | 3/1974 | Edwards | 340/323 R |
| 3,919,686 | 11/1975 | Narbaits-Jaureguy . | |
| 4,449,114 | 5/1984 | Fascenda | 340/988 |
| 4,471,345 | 9/1984 | Barrett, Jr. | 340/572 |
| 4,495,496 | 1/1985 | Miller, III | 340/825.54 |
| 4,551,725 | 11/1985 | Schaffer | 343/6.5 SS |
| 4,785,282 | 11/1988 | Martell et al. | 340/323 R |
| 4,857,886 | 8/1989 | Crews | 340/323 R |

FOREIGN PATENT DOCUMENTS

| | | |
|---|---|---|
| 2619644 | 8/1989 | France . |
| 2163324 | 2/1986 | United Kingdom . |

*Primary Examiner*—Donnie L. Crosland
*Attorney, Agent, or Firm*—Griffin Branigan & Butler

[57] ABSTRACT

This arrangement enables the identification of a plurality of vehicles (4) and determination of the instant of their passing over a reference line (30). It includes a moving station (1) mounted on the vehicle and a fixed station (2) arranged alongside a racetrack (3). The fixed station broadcasts a low-frequency synchronization signal of period T which is received by the moving station, the latter in turn broadcasting a series of signals of duration Tn located in a predetermined rank relative to the time $t_0$ marking each start of period T. Conjointly the moving station allocates an identification code peculiar to a given moving object to each signal Tn. The signals received by the fixed station are stored in a memory which for each signal memorizes its absolute time, its association with a given vehicle and its amplitude. The arrangement is used for motor vehicle races which include a large number of competitors.

20 Claims, 13 Drawing Sheets

| FIG. 6A | FIG. 6C |
|---|---|
| FIG. 6B | FIG. 6D |

ARRANGEMENT FOR TIMING MOVING OBJECTS

This invention concerns an arrangement for the identification of a plurality of moving objects and determination of the instant of their passing over a reference line, such arrangement comprising a fixed station including a transmitter-receiver equipped with an antenna situated in the neighbourhood of the reference line and a plurality of moving stations comprising a transmitter-receiver mounted in each of the moving objects, the fixed station being arranged to broadcast a radioelectric signal and to receive radioelectric signals coming from the different moving objects, the moving stations being arranged to receive the radioelectric signal broadcast by the fixed station and in response to said signal, to elaborate a broadcast signal picked up by the fixed station and enabling the determination of the time of passage and the identity of each moving object.

BACKGROUND OF THE INVENTION

Timing arrangements answering to the generic definition given hereinabove are known.

An installation for the identification and determination of the instant of passage of a plurality of moving objects at a predetermined point of their trajectory is described in the patent EP-B-0074330 (USA-4 551 725). This installation, particularly adapted for timing automobile races, comprises in particular an arrangement mounted on board each moving object, a fixed receiving antenna and means for processing identification signals broadcast by the transported arrangements. Furthermore, a transmitter is provided which serves on the one hand to trigger means for developing identification signals and which on the other hand serves as reference for these means which thus do not include their own time base.

The installation which has just been summarily described gives rise to the difficulty of being utilizable for a limited number of vehicles only Furthermore, the apparatus to be carried is relatively cumbersome which limits its employment to vehicles having a sufficiently large volume.

To overcome these difficulties, the installation described in the document FR-A-2 619 644 includes a plurality of main transmitters carried by the respective vehicles, each to detect and generate an electromagnetic wave modulated by a high frequency associated respectively with the vehicle under consideration, such electromagnetic wave being preferably in the infrared range. The installation further includes a principal receiver comprising a sensor based at a fixed station proximate a detection place and sensitive to the electromagnetic waves generated by the different main transmitters. The receiver further includes a plurality of modules, in number equal to the number of transmitters, each provided with discrimination means adapted to respectively isolate a specific high frequency component from the signal issued by the sensor and means adapted to detect the maximum amplitude of such component.

Aside from the fact that the recommended infrared wave may present transmission difficulties, the installation presents the difficulty of requiring the employment of as many different receivers as there are vehicles which overburdens and complicates considerably the receiver. Such receivers moreover call on old technologies, those in particular of the superheterodyne which as long known require as many local oscillators as there are frequencies under consideration in order to bring about the change of frequency. These techniques are burdensome and necessitate a large number of components.

This invention has as its purpose to avoid the difficulties described hereinabove in calling on a single receiver which is sensitive to the various broadcasts coming from the vehicles, such receiver exhibiting a relatively simple structure because of its employment of digital sampling techniques. Such techniques have never been proposed for timing sporting races.

SUMMARY OF THE INVENTION

Thus, the arrangement of the present invention is characterized by the fact that the radioelectric signal broadcast by the fixed station is modulated by a low frequency synchronization signal of period T which is received by the moving station, this latter being provided with means placing each moving station in a state to broadcast during each period T a signal of duration $Tn << T$ occupying, within the period T, a rank peculiar thereto relative to a time to marking the beginning of each period T, such rank remaining the same for all successive periods T, the moving station further comprising means for attributing an identification code peculiar to each moving object to each signal of duration Tn, the signal of duration Tn thus obtained modulating the radioelectric signal broadcast by the moving station, that the radioelectric signals broadcast by the moving stations are received by the fixed station which includes first means for recognizing the signals of duration Tn belonging to the same moving object, second means for taking into account the respective amplitude of such signals, third means for situating said signals relative to an absolute time and a memory for storing within a predetermined zone attributed to each moving object the signals thus obtained, and that the signals stored in the memory are processed by a microcomputer in order to render them usable on a display system, said signals enabling the determination of the time of passage of each of the moving objects over the reference line.

The invention is now to be described with the help of the attached drawings which illustrate it by way of example.

DESCRIPTION OF THE PREFERRED EMBODIMENT

Figure 1A:
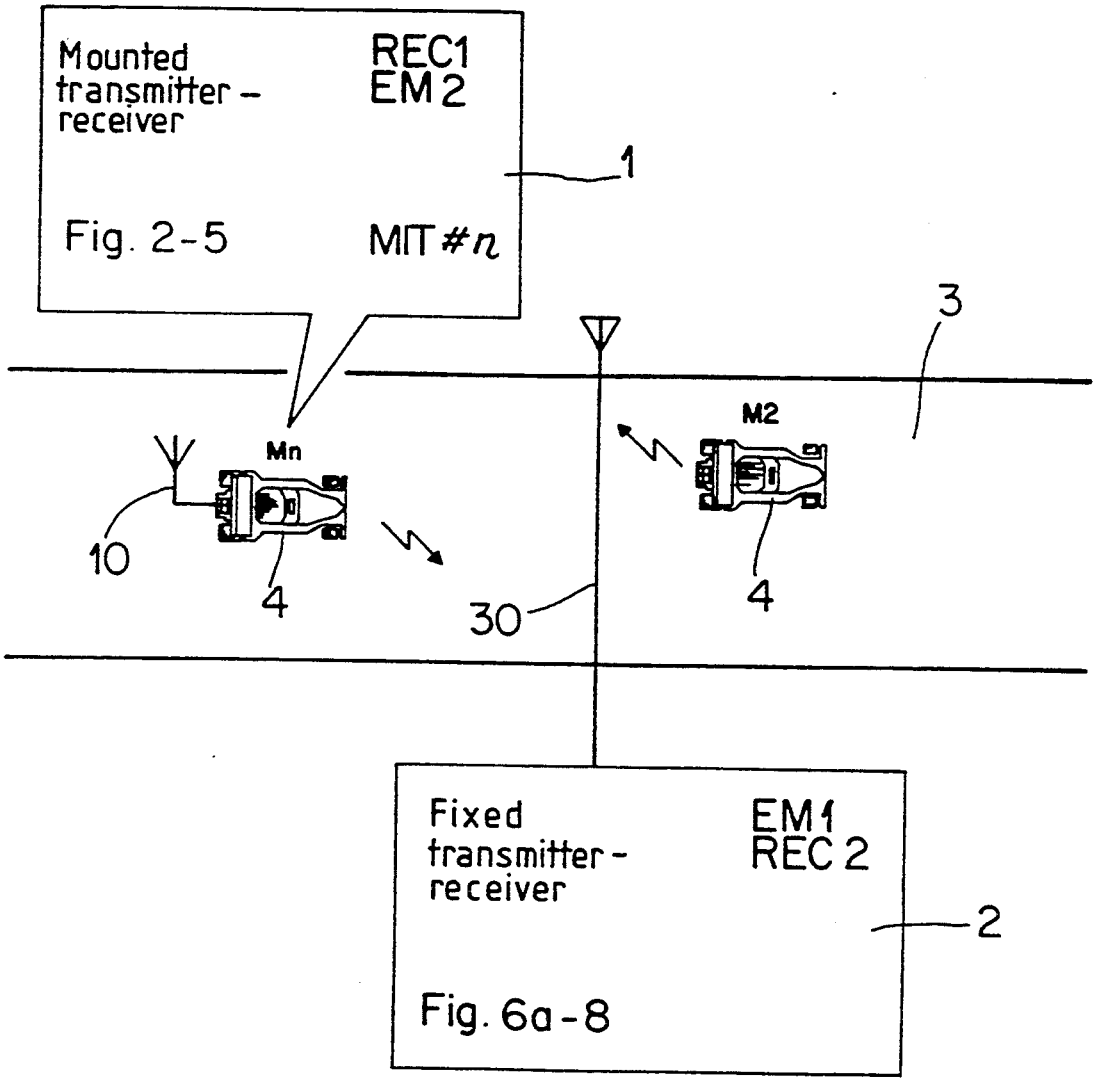
FIG. 1*a* is a simplified general view of the arrangement according to the invention, where vehicles each transport a moving station and where a fixed station receives information coming from the moving stations.

FIG. 1*a* shows a race track 3 on which several cars or moving objects 4 are in competition. The arrangement which is to be described enables the identification and determination of the instant of passage of the moving objects 4 over a reference line—which could be the finish line—this reference line here being merged with a cable 30 forming an antenna. On each vehicle 4 (FIG. 1*a* shows vehicle M2 bearing the number 2 which has already crossed the line and a vehicle Mn bearing the number n which is approaching such line) is mounted a transmitter EM2—receiver REC1 symbolized by the number 1. Such transmitter-receiver is connected to an antenna 10 coupled to vehicle 4. In the remainder of this exposition such transmitter-receiver will preferably be called moving station or MIT (moving identifier transmitter) followed eventually by an order number. Here MITn symbolizes the moving station mounted on vehicle Mn. FIG. 1*a* shows that at the edge of track 3 is located a fixed transmitter EM1-receiver REC2 symbolized by the number 2. This transmitter-receiver will preferably be called hereinafter the fixed station. The fixed station is connected to antenna 30 located in the neighbourhood of or merged with the reference line. In a completely general fashion, the fixed station 2 is arranged to broadcast a radioelectric signal and to receive radioelectric signals coming from the different moving stations 1. In the same manner, the moving stations 1 are arranged to receive the radioelectric signal broadcast by the fixed station 2 and, responsive to said signal, to elaborate a broadcast signal picked up by the fixed station 2 which enables—as will be seen in detail hereinafter—the determination of the time of passage and the identification of each moving object 4.

Figure 1B:
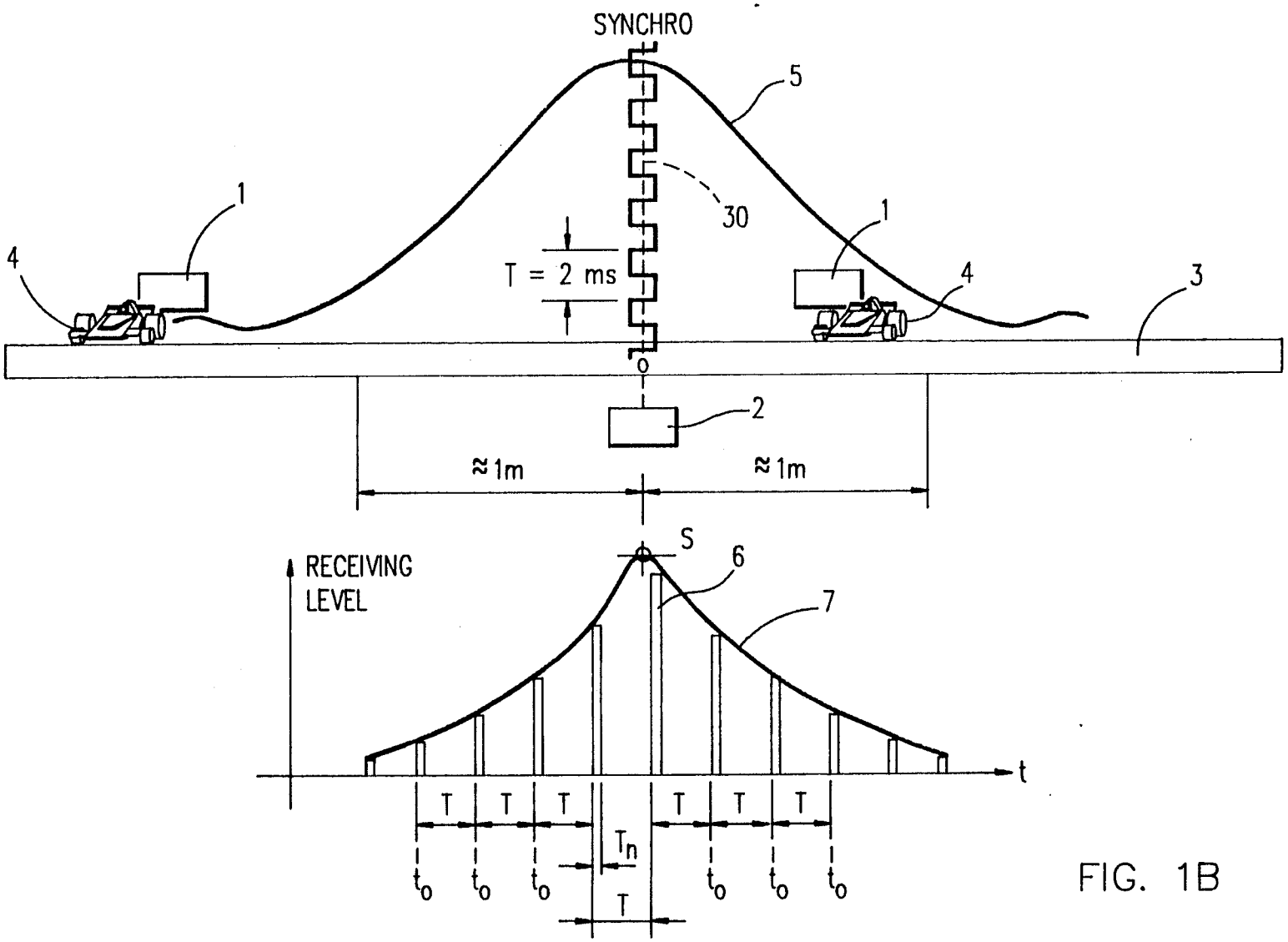
FIG. 1*b* is a greatly simplified schematic of the operation of the arrangement according to the invention.

Reference will now be had to FIG. 1*b* in order to explain more specifically the contents of the invention. Here are to be found vehicles 4 moving along track 3, each vehicle bearing with it a moving station 1. At the edge of the track is found the fixed station 2 already mentioned. If the moving station 1 were to broadcast continuously —as is the case of the arrangement described in the cited document FR-A-2 619 644—antenna 30 would gather a continuous signal 5 in the form of a bell, the maximum amplitude of which would be located in the neighbourhood of the antenna 30. Continuing with the same document, differentiation of this bell curve would then enable knowing with exactitude the time of passage of the vehicle over antenna 30.

The procedure followed by the present invention is different. Effectively, as may be seen on FIG. 1*b*, the fixed station 2 broadcasts a radioelectric signal modulated by a signal referred to as low frequency synchronization of period T which may take the value, for instance, 2 ms (500 Hz). This signal is received by the moving station 1. The moving station is provided with means placing it in a state to broadcast during each period T a signal of duration Tn, much smaller than T and which occupies within the period T a rank peculiar to it relative to a time $t_o$ marking the beginning of each period T. This is apparent from the diagram at the bottom of FIG. 1*b*. In this figure signal Tn, the duration of which is exaggeratedly long relative to signal T in order to clarify the explanation, begins with the commencement of period T. Another vehicle would present a same signal Tn but shifted relative to the beginning $t_o$ of period T. All signals of duration Tn shown on FIG. 1*b* are broadcast by the same vehicle since they all possess the same rank for all the successive T periods.

Practical measures have shown that the synchronization signal of period T is utilizable in a zone of ±1 m relative to antenna 30. If one assumes a period of T=2 ms and that the speed of the vehicle is 300 km/hr., said vehicle in 2 ms, will traverse 0.166 m. It thus broadcasts according to the principle described hereinabove, a signal of duration Tn for each 0.166 m traversed which is the same as to say that over a distance of 2 m, each vehicle will broadcast 2/0.166=12 signals of duration Tn with an additional space less a signal Tn, this appearing at the bottom of FIG. 1*b*. This result shows that signal Tn referenced 6 is that which exhibits the greatest amplitude. It is thus apparently that which is found closest to the reference line and it alone could be taken in consideration in order to obtain the absolute time of passage of the vehicle over this line. One may note however that the resolution of the measurement may be improved if one employs all the signals Tn and one traces the curve envelope 7 such as it appears on the figure. The point of passage S is then found shifted to the left of signal Tn 6 and the precision of the measurement is not increased thereby. But such is not the object of this invention, which has as its essential purpose moving stations 1 and one fixed station 2 capable of creating for each vehicle the set of signals Tn which appears at the bottom of FIG. 1*b*.

To this end and in addition to what has already been said hereinabove, the moving station 1 further includes means for attributing to each signal of duration Tn an identification code peculiar to each particular vehicle, the signals of duration Tn thus obtained modulating the radioelectric signal broadcast by the transmitter EM2 of the moving station 1 as will appear in detail when operation of the moving station is explained with reference to FIG. 2. The signals broadcast by the moving station 1 are received by the fixed station 2 which includes, as will be seen on FIGS. 6A-6D, first means for recognizing the signals of duration Tn belonging to the same moving object, second means for taking into account the respective amplitude of such signals, and third means for situating such signals relative to an absolute time. As will appear hereinafter, all these signals are stored in a memory, then processed by a microcomputer in order to render them exploitable on any display system.

There will now be described in detail the operation of the moving stations and the operation of the fixed station by means of schematics and timing diagrams. It will be understood that these schematics are examples which enable putting the invention into practice One could naturally conceive of other arrangements without departing from the principal idea which is the object of this invention.

1. The Moving Station

Figure 2:
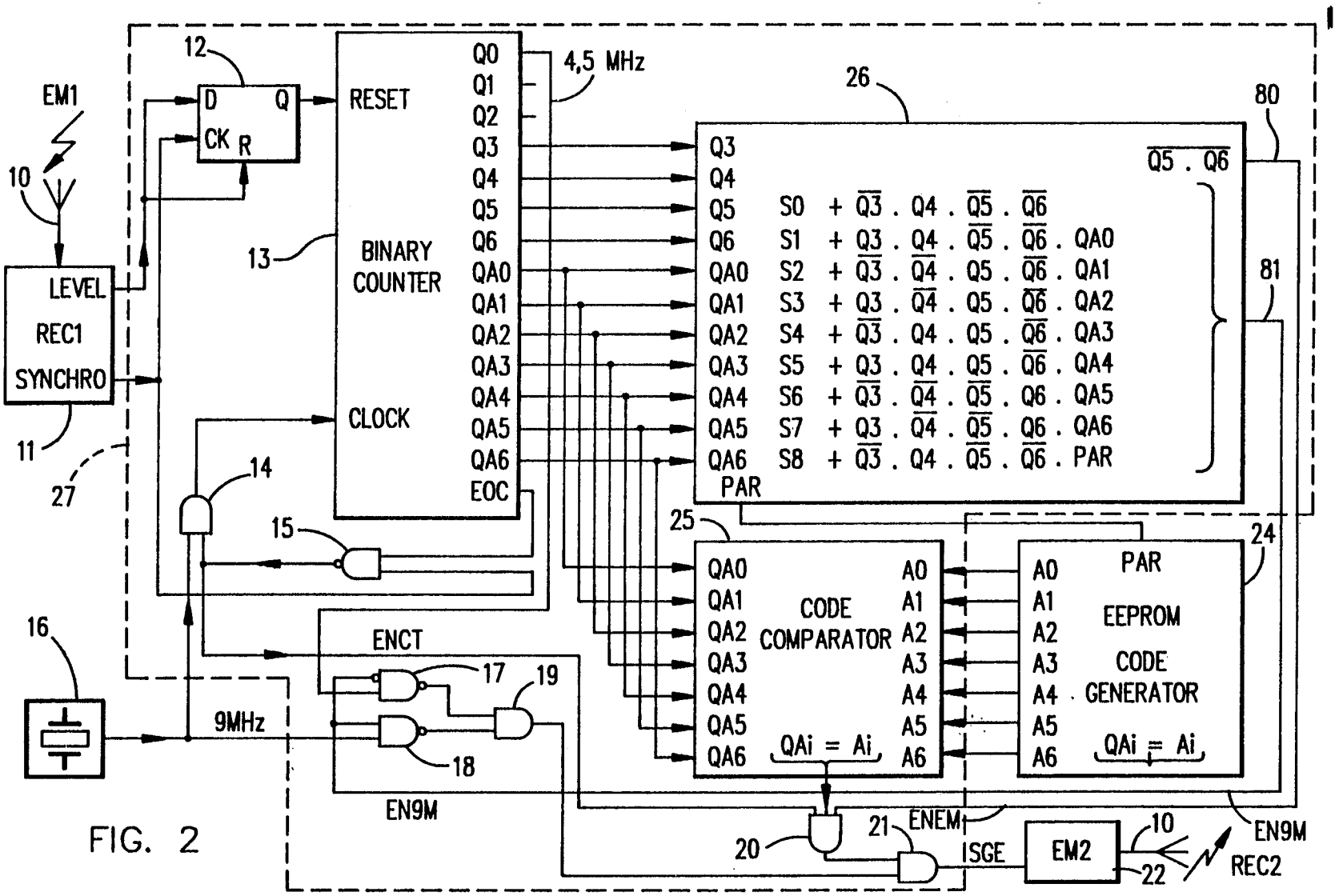
FIG. 2 is a detailed schematic of the moving station.
Figure 3:
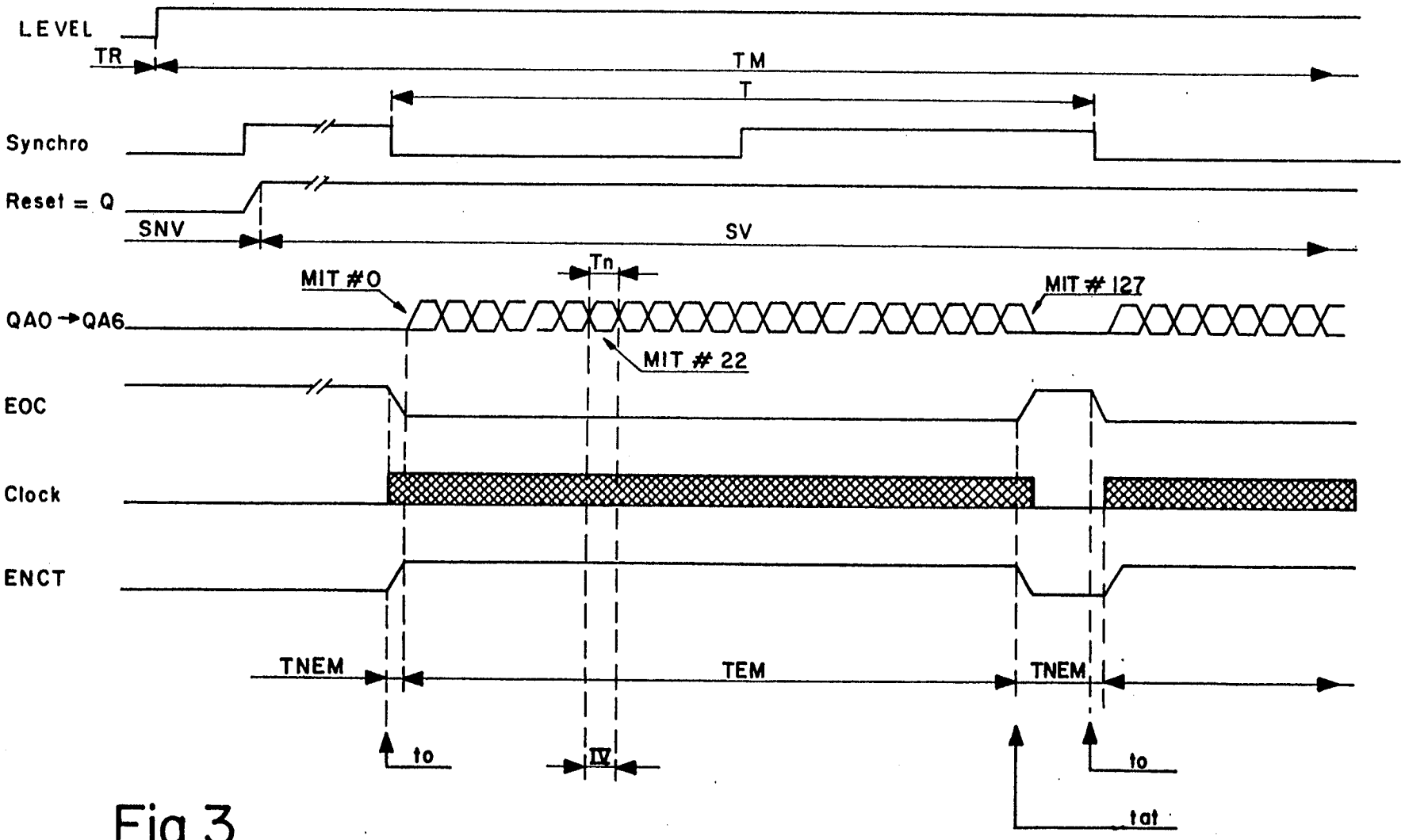
FIG. 3 is a timing diagram explaining the operating principle of the moving station of FIG. 2.
Figure 4:
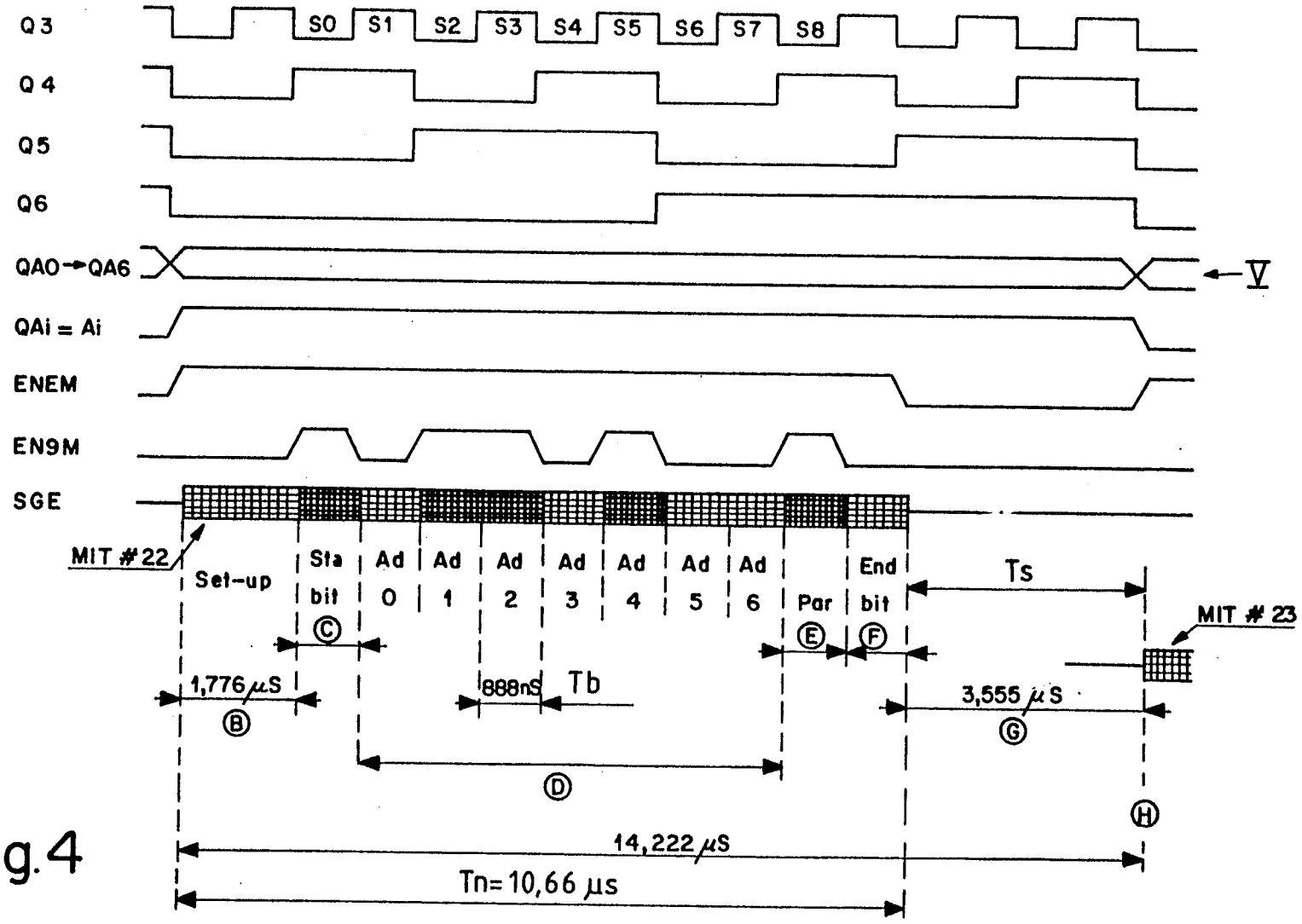
FIG. 4 is a timing diagram of the zone referenced IV in FIG. 3.
Figure 5:
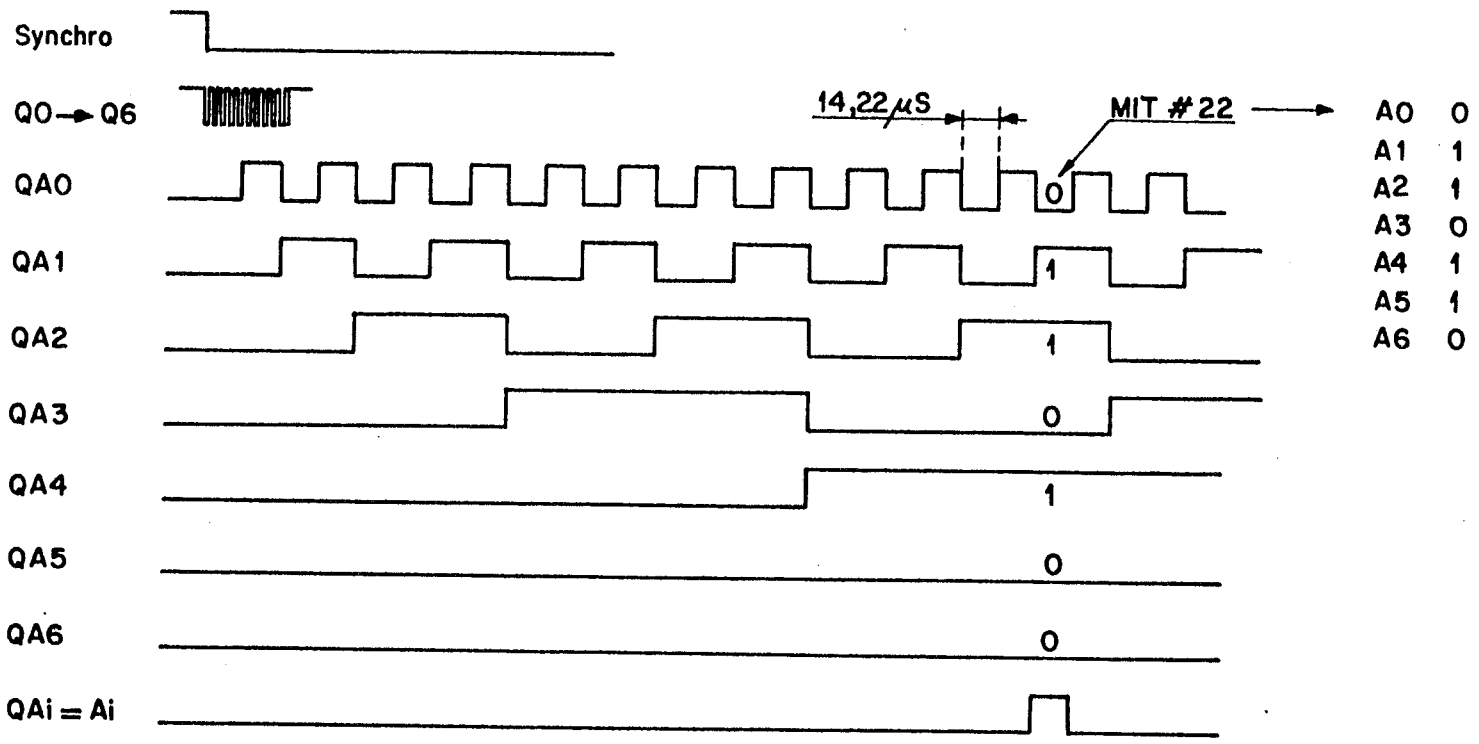
FIG. 5 is a timing diagram of the zone referenced V in FIG. 4.

A possible practical schematic is shown on FIG. 2 and timing diagrams corresponding to this schematic are shown in FIGS. 3, 4 and 5. Each vehicle includes such a moving station. This station includes electronic circuits coupled together by connections which appear on the schematic.

The transmitter EM1 of the fixed station (FIGS. 6*a* and 6*b*) broadcasts a radioelectric signal which is received by the moving station in its receiver REC1 through the medium of its antenna 10. Following demodulation, receiver 11 furnishes a low frequency synchronization signal of period T on its output "synchro" and a signal (level) indicating that the level of the synchronization signal is sufficient. These signals appear on FIG. 3. Before the rise of the signal level, the moving station or MIT is inactive (TR) while after receiving such signal, it comes into activity (TM). The signal level is connected to the input D (data) and to the terminal R (reset) of a D type flip-flop referenced 12, the clock entry CK of this flip-flop receiving the synchronization signal "synchro". As soon as the signal level passes to 1, the flip-flop is placed in a waiting condition for the first falling edge of the synchro T. Prior thereto, it will be understood that as long as the input D is at zero, the output Q of the flip-flop is at zero. As soon as the signal level goes to 1, the first positive edge of synchro T causes the output Q of the flip-flop to change to 1, this being coupled to the reset input of a binary counter 13. Such change to 1 puts all the outputs Q (Q0 to QA6) of the counter to zero and the output EOC (end of count) of said counter to 1. It is understood that before the rise to 1 of the output Q of flip-flop 12 the synchro T is non valid (SNV) and it becomes valid (SV) following such rise. The output EOC of counter 13 and the synchronization signal are connected to the input of a NAND-gate 15. When the output EOC is at 1 and the synchro changes over to 1, the output of gate 15 is at zero. The output of the gate 15 is coupled to the first input of an AND-gate 14 which receives on its second input the signal furnished by the high frequency time base 16. When the output of gate 15 is at zero, the output of gate 14 coupled to the clock input of counter 13 is also at zero and this state is stable as long as the output EOC of the counter remains at 1. When the first falling edge of the synchro goes to zero, the output EOC goes to zero which gives 1 at the output of gate 15 in a manner such that gate 14 allows the high frequency signal coming from time base 16 to be transmitted, this bringing about the start up of binary counter 13.

The negative flank of the synchro corresponds to time $t_0$ marking the beginning of each period T. Before this, the MIT is located outside the broadcast zone (TNEM) while it is within the broadcast zone (TEM) upon reception of the negative flank.

FIG. 2 shows that the MIT further comprises a code generator 24 which can be an EEPROM memory. Such generator 24 includes outputs A0 to A6 which are permanently in predetermined logic states, such states being different for each of the MIT under consideration. Here, for example, there has been chosen as example MIT number 22 for which the outputs A0 to A6 are respectively in the states 0110100. The outputs A0 to A6 of generator 24 are connected to the inputs A0 to A6 of a code comparator 25 which receives on its inputs QA0 to QA6 the outputs QA0 to QA6 of the binary counter 13. As shown by the diagram on FIG. 5, when A0 to A6 are equal respectively to QA0 to QA6, comparator 25 furnishes an equality signal QAi=Ai on its output, such state remaining at 1 during a state of QA0. Such logic signal is introduced via a first input into an AND-gate 20. AND-gate 20 receives on a second input a signal ENCT (enable counting) which appears on the diagram of FIG. 3. It is understood that when not counting, for instance when the signal level is equal to zero or before beginning of period T (synchro=1), signal ENCT has a value of zero, but that it goes to 1 as soon as the synchro goes to zero.

FIG. 2 further shows that the moving station includes an operator logic circuit 26 receiving on its inputs the logic values furnished on the outputs Q3 to QA6 of the binary counter 13. Such operator is cabled in order to bring about logic operations according to the equations shown on the figure. The first logic equation furnishes to output 80 a signal ENEM (enable emission) which results from the combination of signals Q5 and Q6 as is apparent from the diagram of FIG. 4. Signal ENEM defines the precise time during which the MIT is in a broadcast state. It is seen on FIG. 2 that signal ENEM goes to a third input of gate 20.

The output of AND-gate 20 is connected to a first input of an AND-gate 21. Thus the transmitter EM2 referenced 22 may broadcast data presented at the second input of gate 21 when the first input of said gate is in the 1 state, which happens when ENCT, ENEM and QAi=Ai are at the 1 state, this state lasting only during the shortest time which is that when ENEM is in the 1 state. There remains to be seen the composition of the data presented at the second input of gate 21.

The second logic operation executed by operator 26 is effected by the equation written on nine lines in the frame bounding the operator This operator furnishes on its output 81 a signal EN9M (enable 9 MHz) which results from the combination of the logic states Q3 to QA6 present at the input of the operator Such signal EN9M appears on FIG. 4 and is found to include the identification code peculiar to the MIT under consideration (here the 22nd). Signal EN9M is sent to a first inverted input of a NAND-gate 17 and to a first input of a NAND-gate 18. When EN9M is at zero, gate 17 is enabled and the 4.5 MHz signal present on the second input of gate 17 is then at the output of such gate. In the same manner, when EN9M is at 1, gate 18 is enabled and the 9 MHz signal present on the second input of gate 18 is then at the output of this gate. Following mixing of the signals of 4.5 and 9 MHz by an AND-gate 19, one finds on the second input of gate 21 signal SGE shown on FIG. 4. Signal SGE modulates in turn the radioelectric signal broadcast by antenna 10 of transmitter 22.

The logic states 1 and 0 of the code peculiar to the MIT under consideration could certainly be broadcast as such by an intermittent succession of broadcasts. For practical reasons however, here there has been preferred a continuous broadcast, the zero state corresponding to the sending of a frequency f2 and the 1 state to the sending of a frequency f1. Also for practical reasons it has been arranged that $f2 \frac{1}{2} f1 \frac{1}{2}$, this corresponding to a simple division by two of frequency f1. If frequency f1 is selected to be 9 MHz, frequency f2 will be 4.5 MHz. Continuing for reasons of simplification, frequency f1 is the same as the frequency of time base 16 incrementing the binary counter 13.

If one returns to FIG. 4 and to signal SGE, it is seen that signal SGE of duration Tn includes the juxtaposition of twelve bits Tb the durations of which are equal. Initially one finds two bits in the zero state (B), called broadcast set-up, which permit the transmitter to be started up, thus constituting a state of preparation of the system. Next, one finds a state bit 1 (C), referred to as start-bit, which is present in order to assure the security of the coding, thereafter bits (Ad0 to Ad6) of coding called (D) corresponding here to the code of MIT number 22. The coding bits are followed by a parity bit (E)

which serves as a check on good reception, the fixed station calculating such parity and comparing it with that which it ought to receive from the MIT. The parity is given by the generator 24, then introduced into operator 26 on the same base as a logic state Q3 to QA6. The parity bit is followed by a bit in the zero state (F), called end-bit, which signals the end of the transmission. There has been chosen in the proposed embodiment a value of Tb equal to the period 1/f1 furnished by the high frequency time base, this period being multiplied by $2^3$. Thus, if f1=9 MHz, Tb will have a value of 888 ns and Tn a value of 10.66 μs.

FIG. 4 further shows that the signal of duration Tn broadcast by a moving station or predetermined MIT (here MIT number 22) is separated from the signal of duration Tn broadcast by the following station (here the MIT number 23) by a security period Ts (G). This period is a zone of silence. It is understood that each MIT individually calculating its broadcast zone from an internal time base, this latter will always present a small frequency disparity relative to the other time bases. It is thus necessary to assure the security period mentioned in order to avoid an eventual overriding of the MITs. FIG. 4 shows that the security period intervenes as soon as signal ENEM returns to zero Zone (G) has been here chosen equivalent to the duration of 4 bits Tb, from whence Ts=3.555 μs. Thus, the recurrence (H) of signal Tn to which is added period Ts itself is of 14.222 μs.

If one refers once again back to FIG. 3, it will be determined that during a synchronization period T there is found a broadcast zone TEM, then a non-broadcast zone TNEM. At the time tat the broadcast zone ends and the system is then awaiting resynchronization thereof, which begins again at the time $t_o$, this for security reasons.

With a time base of 9 MHz and a binary counter including 14 divider stages, the signal ENCT for the end of counting will intervene following $2^{14}/9 \cdot 10^6=0.18$ ms. The security period is thus equal to $2-1.82=0.18$ ms. If the recurrence time is 14.222 μs, one may then place within the 1.82 ms available, 128 MIT representing 128 vehicles in competition, this being quite remarkable.

The material composing the moving station does not call for any particular remarks. It is formed of known elements. Transmitter 22 includes in the practical embodiment which forms an example, two carrier frequencies, one at 427 MHz (which expresses the logic state 1), and the other at 422.5 MHz (which expresses the logic state 0). Receiver 11 is an FM receiver tuned to about 10 MHz with a frequency spread of a value Δf=20 kHz. Frequency modulation is chosen since it is less sensitive to noise. The code generator 24 is an EEPROM memory of the type 93 C 46. The other components enclosed in dashed line frame 27 form a programmable logic circuit (gate array), for instance of the type EP 900 of the Altera Company. It could of course be made up of separate discrete circuits but at the cost of an increased volume. Time base 16 is a quartz oscillator the frequency of which is 9 MHz. The system described, through utilization of digital techniques, enables the offering of a mobile station of very small dimensions.

It is mentioned further that the signal level received by the MIT enables putting it into a quiescent state outside the reduced zone wherein timing and identification must be made (for instance±1 m. from the reference line). One may accordingly employ energization batteries of much smaller dimensions Such a system of quiescence is described for instance in document EP-B-0074330 cited hereinabove.

2. The Fixed Station

Figures 6, 6A:
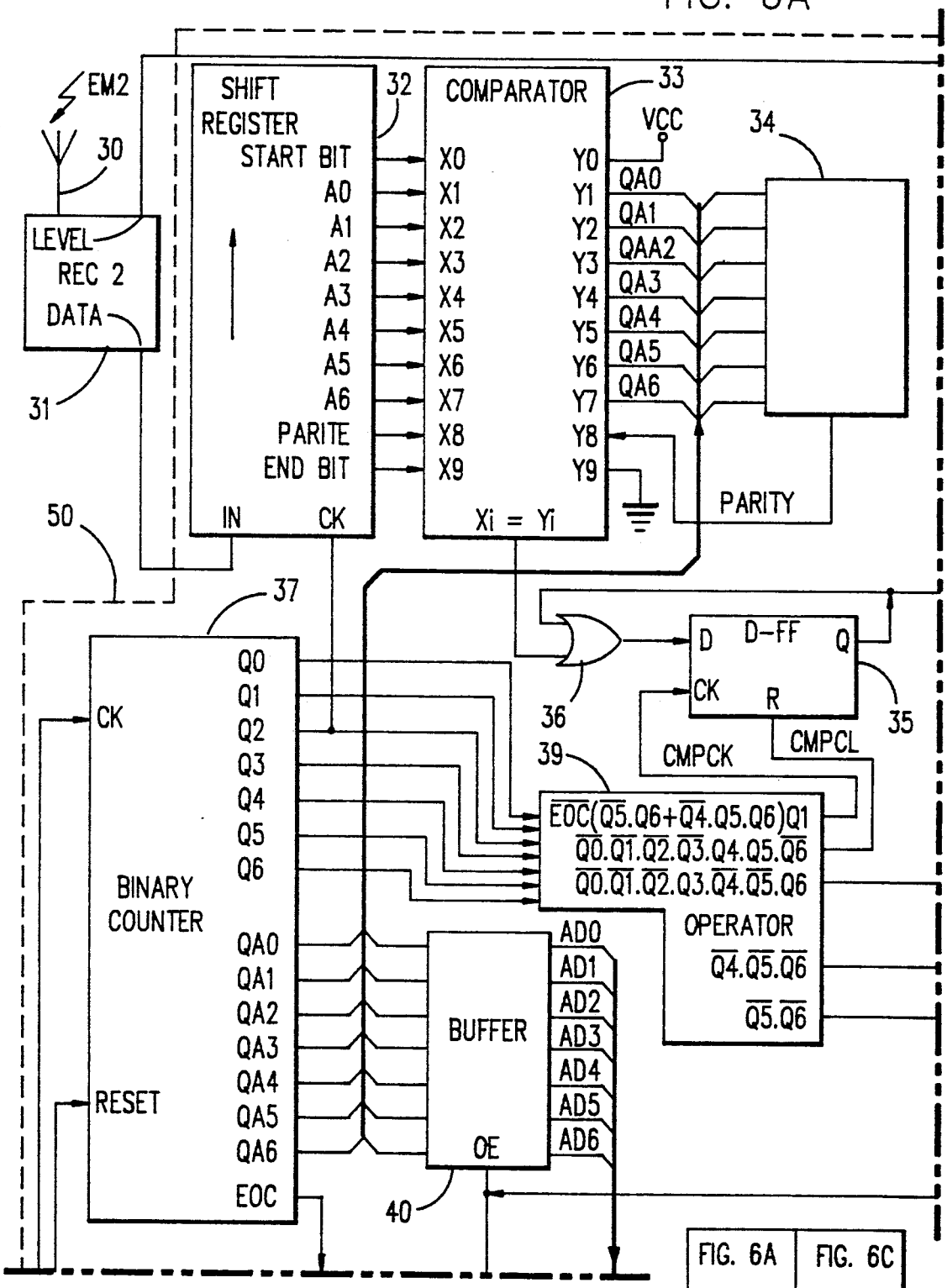
FIGS. 6A–6D, when arranged as shown in FIG. 6, comprise a detailed schematic of the fixed station.
Figure 6B:
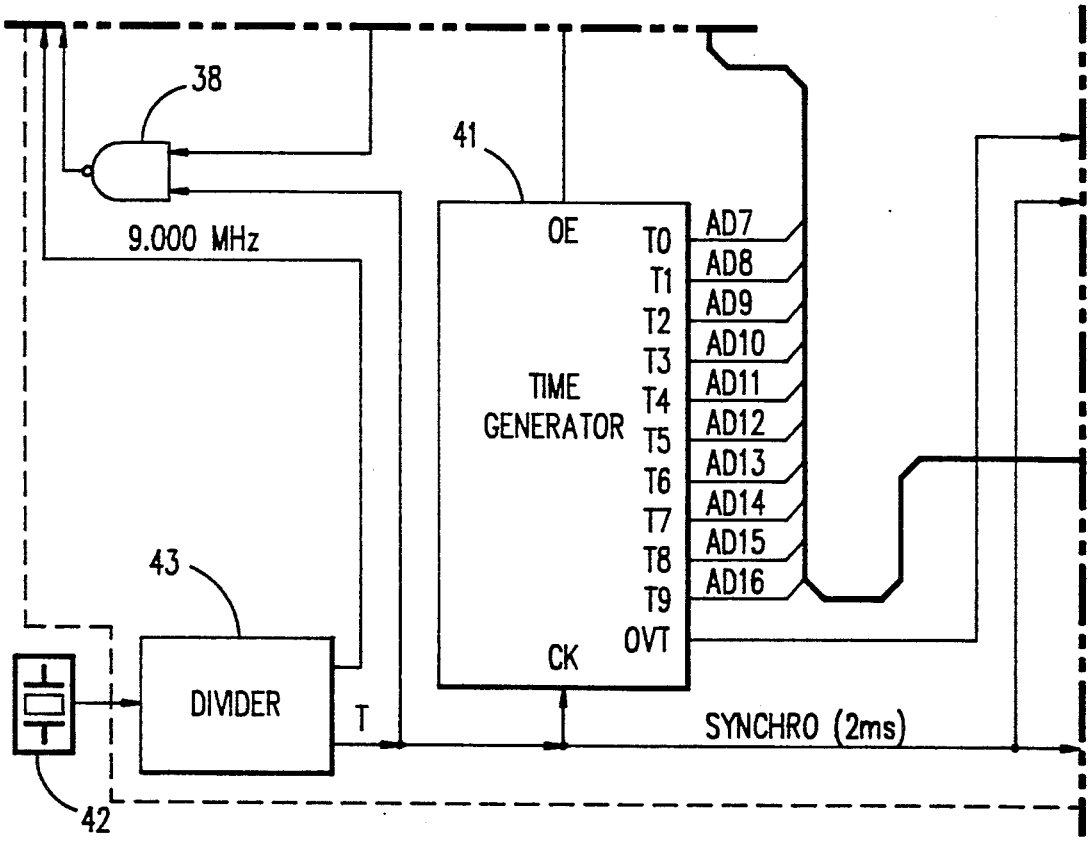
Figure 6C:
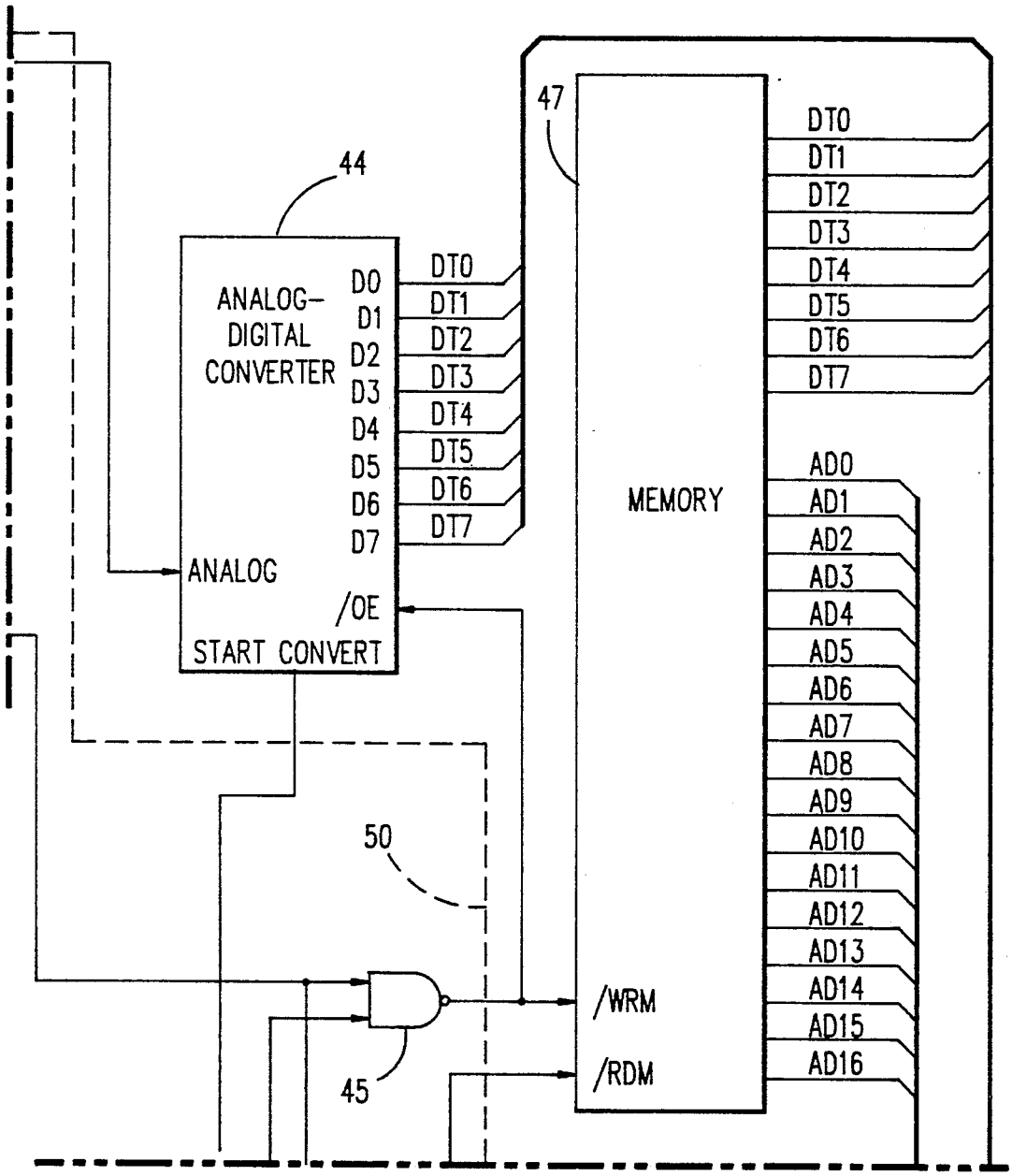
Figure 6D:
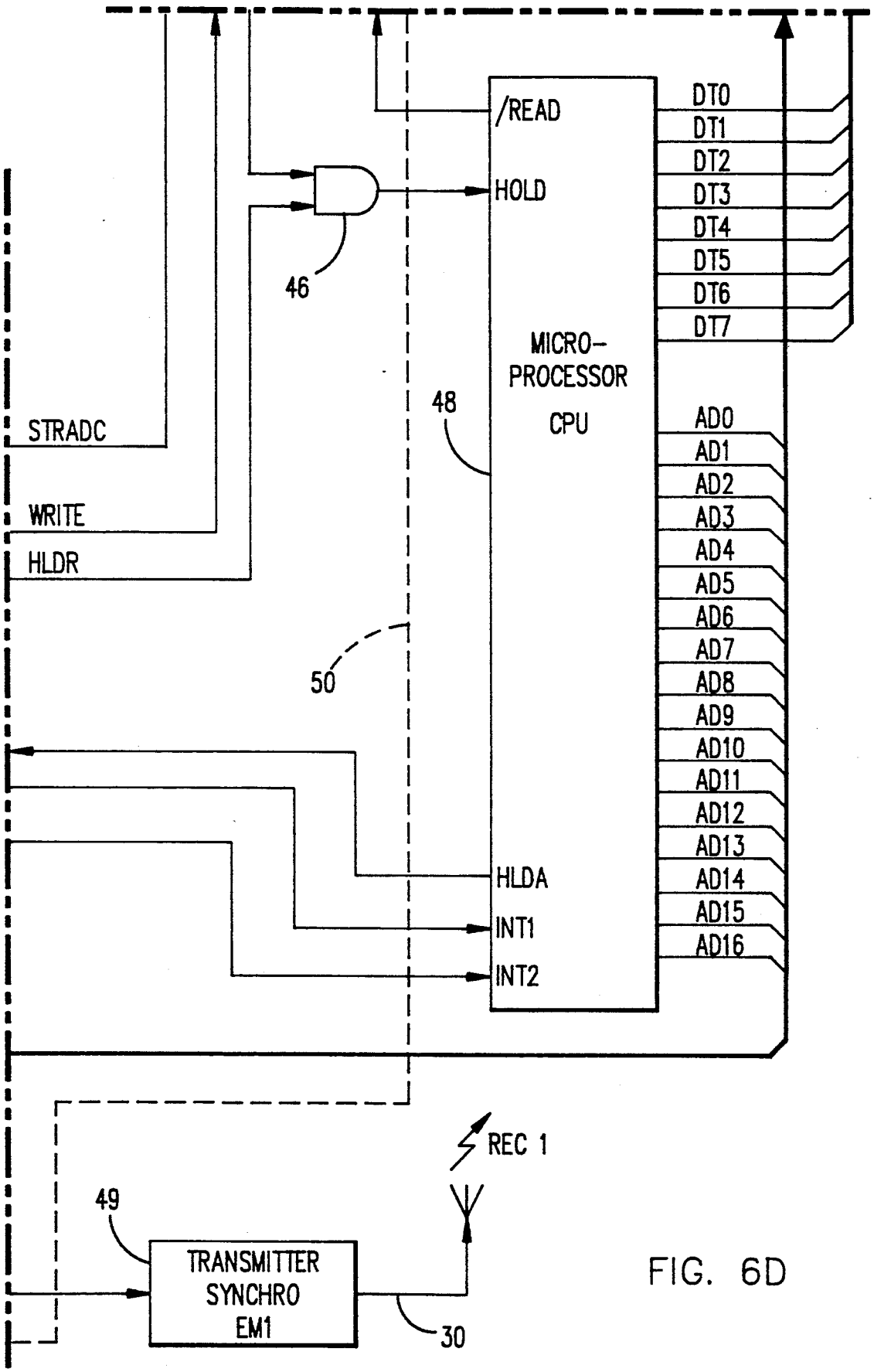
Figure 7:
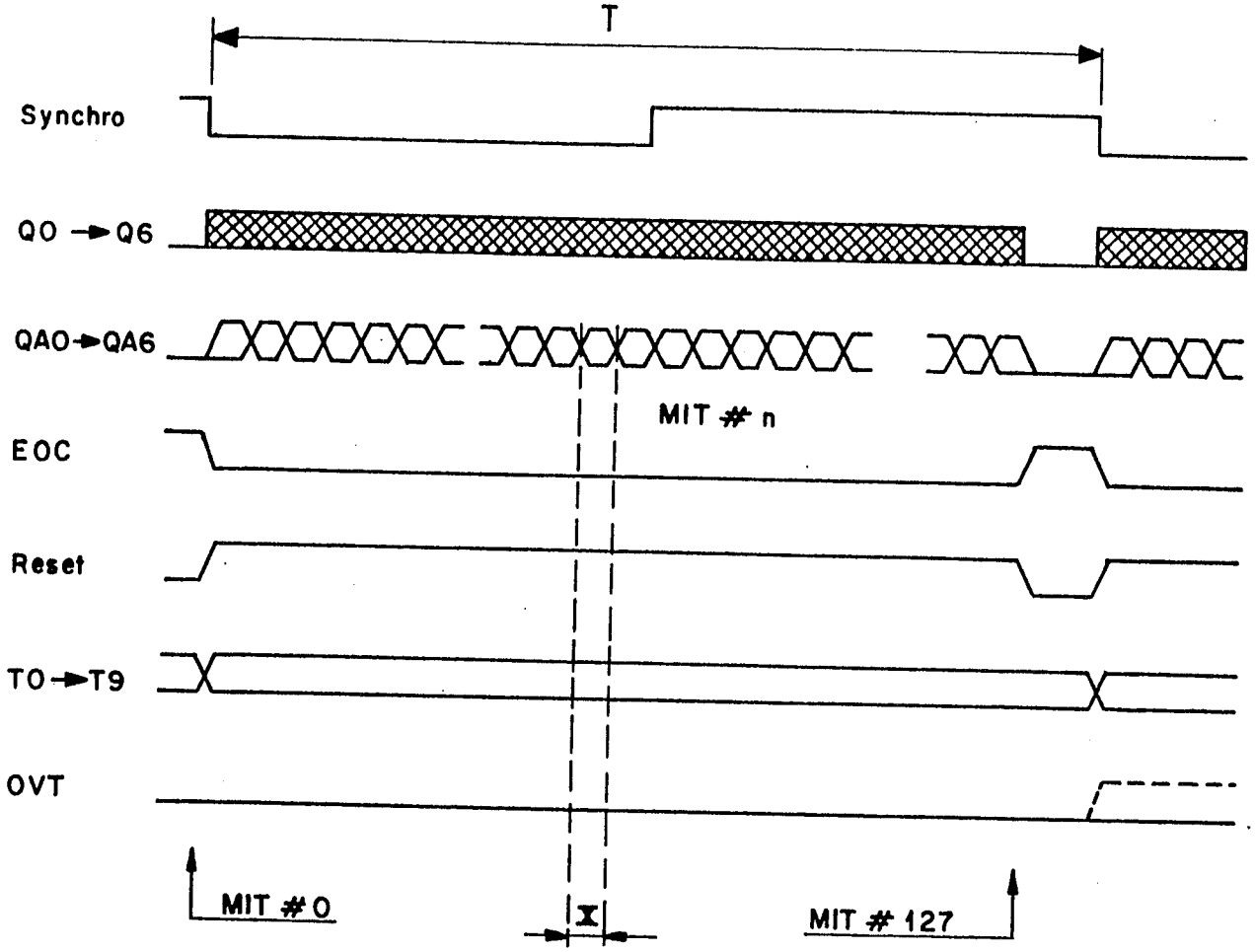
FIG. 7 is a timing diagram explaining the operating principle of the fixed station of FIGS. 6A–6D.
Figure 8:
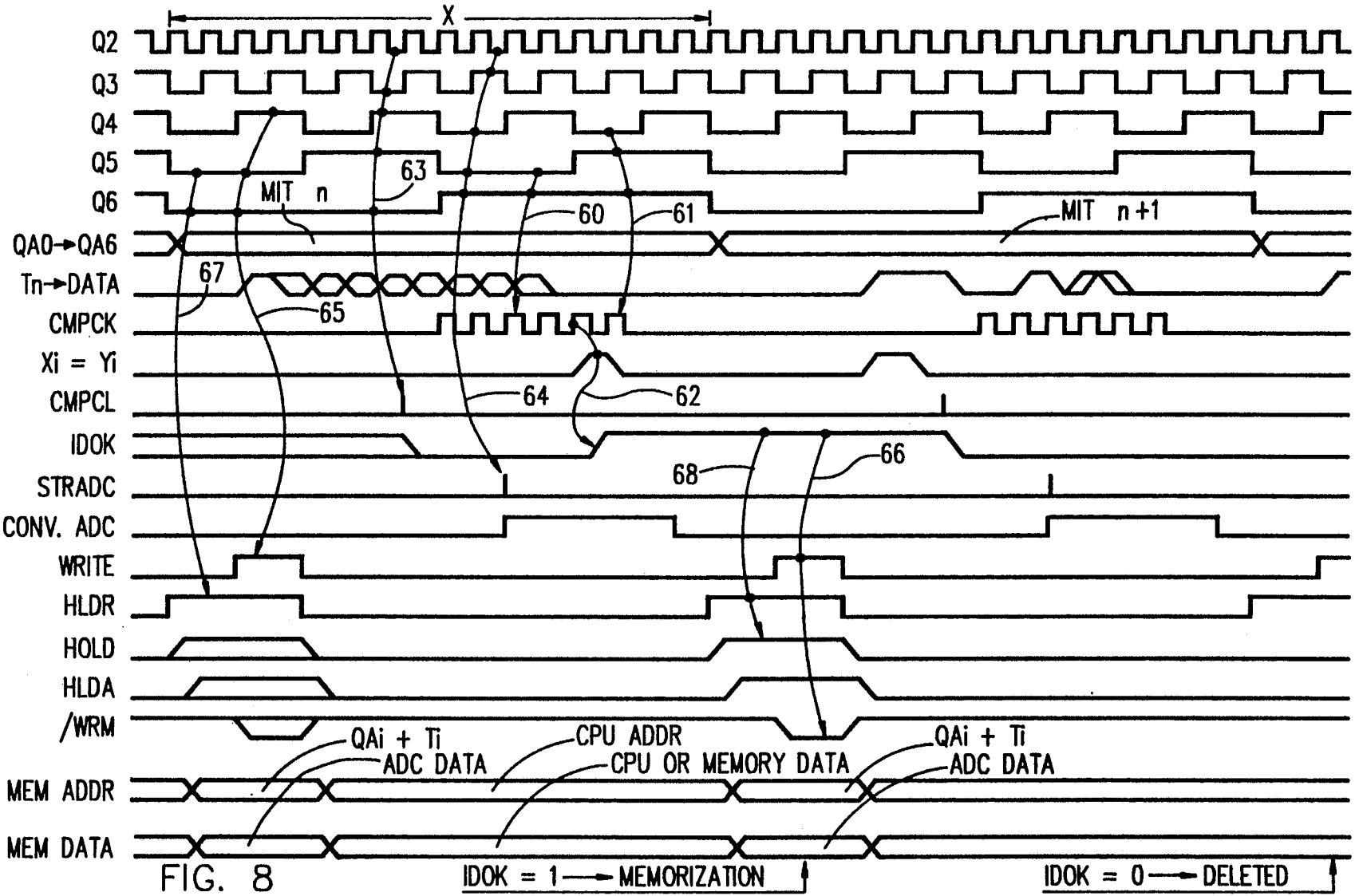
FIG. 8 is a timing diagram showing an enlargement of FIG. 7, the zone X of FIG. 7 being carried over onto FIG. 8 with the same reference X.

A possible schematic of an embodiment thereof appears in FIGS. 6A–6D and the corresponding timing diagrams for this schematic are shown on FIGS. 7 and 8.

The fixed station includes a time base 42 producing a high-frequency signal This signal is introduced into a divider 43 which in turn furnishes a low-frequency synchronization signal of period T also called "synchro". Such signal modulates the transmitter EM1, referenced 49, in the fixed station. It is transmitted by antenna 30 to the moving station where it is employed as described hereinabove. An absolute time generator 41 is incremented by the reference signal of period T. The fixed station further includes a receiver REC2, referenced 31, which via the same antenna 30 receives signals of duration Tn broadcast by transmitters EM2 of the several moving stations. In contrast to the moving stations, all of which work in an independent manner within their peculiar zone, but all of which are receptive to the synchronization frequency of period T, the fixed station operates in all the zones of the moving stations in order to account for all.

The fixed station includes a binary counter 37 which receives the high-frequency signal on its clock input (CK). The synchronization signal T is sent to a first input of a NAND-gate 38 which receives on its second input signal EOC (end of count) present at the end of the binary counter chain 37. The output of gate 38 is connected to the reset input of the binary counter As is seen on the diagram of FIG. 7, when the synchronization signal T goes to zero, the output of gate 38 goes to 1, this having as effect the setting to zero of all the outputs Q0 to QA6 of the counter and setting the output EOC to 1. Thus, when the synchro T starts off (passage from 1 to 0), one guarantees that all the outputs Q0 to QA6 are at zero, which recurs at each passage to zero of the synchronization signal.

Receiver 31 exhibits a data output where the bits of duration Tb constituting the signal of duration Tn coming from a moving station run through. These bits Tb are stored in a shift register 32 via its entry IN which presents at the end of the shift and on the outputs, start-bit to end-bit, the image of an entire period Tn. It will be noted that the introduction of signal Tn into shift register 32 occurs at the rhythm of a frequency Q2 controlling the clock input CK of the shift register (see FIG. 8). The signals present on the outputs of the shift register are then introduced into the first inputs X0 to X9 of a comparator 33, the second inputs Y1 to Y7 of the same comparator being connected to the outputs QA0 to QA6 of the binary counter 37. It will be noted that input Y0 of comparator 33 is connected to the positive of energization Vcc which corresponds to the logic value 1 of the start-bit (FIG. 4), and that the input Y9 of the comparator is connected to the negative of the energization, this corresponding to the logic value 0 of the end-bit (FIG. 4) The parity received on the input X8 and coming from the moving station must correspond to the parity issued from the fixed station coming from data QA0 to QA6 controlling a parity generator 34, the output of which is connected to the input Y8 of comparator 33. When the inputs X0 to X9 are equal respectively to the inputs Y0 to Y9, the comparator produces a logic signal Xi=Yi equal to 1 (see FIG. 8). This signal 1 is sent to input D of a flip-flop 35 through an OR-gate 36. Such flip-flop receives on its clock input a signal CMPCK which comes from an operator 39. Signal CMPCK is generated from signals Q0 to Q6 coming from counter 37 and in accordance with the logic equation appearing on the first line of operator 39. For instance, the value 1 of CMPCK may appear by combining $\overline{EOC}\cdot\overline{Q5}\cdot Q6\cdot Q1$ (FIG. 8, arrow 60) or by combining $\overline{EOC}\cdot\overline{Q4}\cdot Q5\cdot Q6\cdot Q1$ (FIG. 8, arrow 61). It is noted that signal CMPCK is a signal having a frequency equal to that of output Q2 and that it is present in a time zone intentionally wide, since the instant when the entire signal Tn (FIG. 8, data line) is obtained, is not very precise, this being due to the variations of the synchronization signal. If input D, that is to say, Xi = Yi, is at 1 and at a certain moment signal CMPCK goes from 0 to 1, then output Q of flip-flop 35 goes to 1 which indicates that a signal of period Tn has been correctly identified (on FIG. 8, signal IDOK=1, arrow 62). Following each acquisition of a signal of duration Tn, flip-flop 35 is reset to zero and remains inactive as long as signal CMPCK remains active. This reset to zero is necessary in order that the flip-flop be again ready to receive a new signal of duration Tn. Such resetting is brought about by signal CMPCL of short duration and acting on the R input of the flip-flop. Signal CMPCL is generated by operator 39 and in accordance with the equation shown in the second line. In combining $\overline{Q0}\cdot\overline{Q1}\cdot\overline{Q2}\cdot\overline{Q3}\cdot Q4\cdot Q5\cdot\overline{Q6}$ (see FIG. 8, arrow 63), one obtains the expected signal. In other words, it is noted that if in the time interval during which CMPCK is active, the output of comparator Xi=Yi goes to 1, the D input of flip-flop 35 likewise goes to 1 and the output Q goes to 1 at the moment that signal CMPCL arrives on the input R of said flip-flop. From this moment on, the situation will remain stable since the state 1 of output Q will force input D of the flip-flop to 1 via OR-gate 36 and this regardless of the output of the comparator for the remainder of signals CMPCK yet to arrive.

In sum, the signal IDOK (output Q of flip-flop 35), signals in a stable manner the fleeting recognition of the arrival of a correct signal of duration Tn or, in other words, the correct data in the proper rank.

There has been discussed the portion of the diagram of FIG. 8 which concerns the MIT number n (space $\overline{X}$). At the right of the diagram, there has been shown the following MIT bearing the number n+1. One sees here that signal Xi=Yi=1 was not received while signal CMPCK was present, from whence there is no delivery of signal IDOK. One concludes therefrom that the signal of duration Tn of the MIT n+1 is incomplete or incorrect for one reason or another.

FIG. 6A further shows that the signals of duration Tn furnished by receiver 31 as logic data are also furnished by the same receiver as analog signals showing different amplitudes in accordance with their distance from antenna 30. One finds thus at the output of receiver 31 such signals at variable amplitude levels .The output level is connected to the input of an analog-digital converter 44 which exhibits at its outputs DT0 to DT7 the numerical value of the level of the signal of duration Tn. The schematic shows that converter 44 includes an input "start convert" by which one may control the instant of the conversion. Such conversion will take place only after a signal of correct amplitude has been obtained, i.e. towards the end of the reception of signal Tn, but sufficiently early however in order that the calculation of the conversion is ended when it is necessary to store the result. A good compromise consists in effecting the conversion after ⅔ of the message has been received. The input of the conversion control is controlled by a signal STRADC which comes from the operator 39 according to a logic equation given in the third line. One may see on the diagram of FIG. 8 such signal STRADC resulting from the combination of the different outputs Q of counter 37 arranged in accordance with the previously mentioned equation (arrow 64).

According to the explanations which have been given, one now has available in the fixed station the three data which are: the absolute time given by outputs T0 to T9 of generator 41, the number of the MIT under consideration given by outputs QA0 to QA6 of counter 37 and present at the outputs AD0 to AD6 of a buffer 40 and the amplitude of the signal of duration Tn given by outputs DT0 to DT7 of converter 44. These data being transitory, it is necessary to memorize them in a memory 47 into which arrive all the data DT0 to DT7 and AD0 to AD16 via a bus coupling converter 44, buffer 40 and time generator 41 to memory 47. The writing of data into the memory is brought about through input WRM which is controlled by a NAND-gate 45. The first input to this gate is coupled to signal IDOK and the second input to an output (write) of operator 39. The write output results from the combination $\overline{Q4}\cdot\overline{Q5}\cdot\overline{Q6}$ which appears on the diagram of FIG. 8 (arrow 65). If the signal IDOK=0, gate 45 furnishes a signal 1 and there is no writing into the memory since input WRM is active only if WRM=0. If IDOK=1 (signal Tn well received) and if write=1, WRM goes to 0 and all the data present at the inputs of memory 47 are written into said memory (arrow 66 of FIG. 8).

Memory 47 works together with a microcomputer CPU 48. This microcomputer receives on its inputs the same data DT0 to DT7 and AD0 to AD16 present at the input of the memory. Here the memory employed is of the type DMA, i.e. a direct access memory. The system is arranged in a manner such that writing into the memory has priority over the processing in the CPU. The CPU has a hold input controlled by an AND-gate 46 One finds on the first input of this gate signal HLDR coming from operator 39. As is seen on the diagram of FIG. 8, such signal HLDR appears with each signal of duration Tn, such signal being formed by the combination $\overline{Q5}\cdot\overline{Q6}$ (arrow 67 of FIG. 8). If HLDR=1 and if IDOK=1 (arrow 68 of FIG. 8), gate 46 furnishes a signal 1 to the hold input of the CPU. At this instant, the CPU notes a request for setting to zero of the rest state and gives acknowledgement by liberating (placing at high impedance) all the outputs DTi and ADi in placing output HLDA at 1 (see FIG. 8). This has as consequence the connection of the data QA0 to QA6 of counter 37 as well the data T0 to TA9 of time generator 41 onto the inputs of memory 47. There next follows the writing in as such which, by the signal write=1 and the signal IDOK=1, will be applied to input WRM of memory 47.

Figure 9:
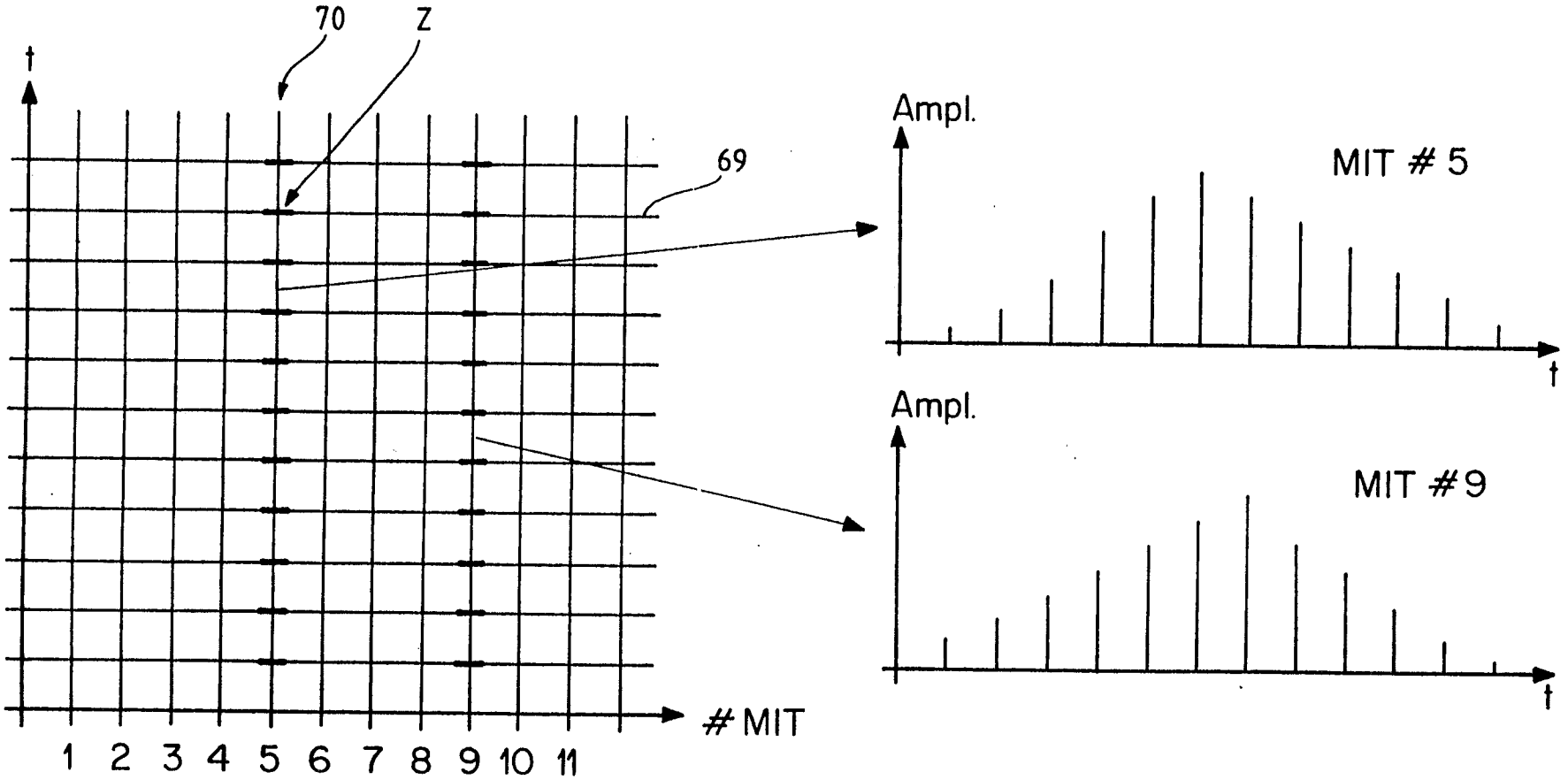
FIG. 9 is a diagram showing how the memory of FIG. 6C is organized and how the data in such memory appear when rendered accessible.

The left portion of FIG. 9 shows how memory 47 is organized. It includes a network of rows 69 and columns 70 which intersect. A row is representative of absolute time t and a column is representative of all the signals of duration Tn broadcast by a same MIT. The data relative to the amplitude of a particular signal of duration Tn is located at the intersection Z of a row and of a column. It will be noted that it is during the writing into the memory that the result present at the output of converter 44 appears on the inputs of memory 47 and will thus be stored at the row and the column chosen by the addresses AD0 to AD16. When this operation is finished, the signal hold is cut off, which liberates the microcomputer CPU 48.

In order to be complete, it is mentioned that the CPU further includes two inputs INT1 and INT2 which are interrupt signals. Signal INT1 (OVT) coming from time generator 41 (see also FIG. 7) is a signal indicating an overstepping of the time. Effectively, the time capacity of generator 41 is limited to, let us say about two minutes. Thus, accounting over these two minutes is assured by the CPU. This latter is thus warned of each overflow of the maximum capacity of time generator 41 by line OVT acting on INT1. As is shown by the schema of FIGS. 6*a* and 6*b*, signal INT2 appears at each return of the synchronization signal. This exhibits unquestionable utility since it is at this moment that the CPU will undertake a complete reading of the time line from the memory in retrieving the addresses occupied by the data (following which it will reset these addresses to zero). One thus knows which moving station has been received, at which moment, and at which amplitude. This appears clearly in the two graphs at the right of FIG. 9, which give for MIT 5 and 9 (by way of example) an arrangement of the different signals of duration Tn as a function of their amplitude. The absolute time is given by the abscissa (t) and the amplitude by the ordinate (ampl.). It will be understood that from these final data one may read the requested information, namely at what moment vehicle n has crossed the reference line. It has already been mentioned above that the time of passage may be judged from the signal of duration Tn which exhibits a maximum amplitude or by an envelope embracing all the signals and from which one retains the moment such passes through a maximum.

As has already been said, transmitter 49 diffuses the synchronization signal in frequency modulation. The receiver is tuned to a frequency on the order of 420 MHz (see above). Such a frequency is difficult to transmit by cable to a command and processing post distant from the race course. One will thus prefer to arrange a first moveable station proximate the track which is capable of undertaking a frequency change (for example to 34.5 MHz for the zero state of the signal and to 39 MHz for the 1 state of the signal). Such frequencies are accommodated by a cabled medium in order to be transmitted into a control cabin situated far from the track.

The elements employed in the construction of the fixed station do not as a matter of principle exhibit any great difficulty. Thus, the CPU 48 could be of the type Intel 80286, memory 47 of the type Hitachi HM 64256 and the converter of the type LCT 1099. The time base 42 is preferably of the quartz type having a frequency equal to 9 MHz. The other elements shown on FIGS. 6*a* and 6*b* may be of the conventional types. One will prefer however to employ, as in the case of the moving station, a programmable logic circuit, for instance of the Altera EP 900 type.

What we claim is:

1. An arrangement for the identification of a plurality of moving objects and determination of the instant of their passing over a reference line, such arrangement comprising a fixed station including a transmitter-receiver provided with an antenna located in the neighborhood of the reference line and a plurality of moving stations including a transmitter-receiver mounted in each of the moving objects, the fixed station being arranged to broadcast a radioelectric signal and to receive radioelectric signals coming from the different moving objects, the moving stations being arranged to receive the radioelectric signal broadcast by the fixed station and in response to said signal, to broadcast a radioelectric signal which is picked up by the fixed station, wherein the radioelectric signal broadcast by the fixed station is modulated by a low-frequency synchronization signal of period T which is received by the moving station, each moving station including means for placing the moving station into a state to broadcast a signal of duration $Tn << T$ during each period T, occupying within the period T a rank peculiar thereto relative to a time $t_o$ marking the beginning of each period T, such rank remaining the same for all of the successive periods T, the moving station further comprising means for attributing an identification code peculiar to each moving object to each signal of duration Tn, the signal of duration Tn thus obtained modulating the radioelectric signal broadcast by the moving station, wherein the radioelectric signals broadcast by the moving stations are received by the fixed station which includes first means for recognizing the signals of duration Tn belonging to the same moving object, second means for taking into account the respective amplitude of such signals, third means for ranking such signals relative to an absolute time and a memory for storing the signals thus obtained within a predetermined zone attributed to each moving object, and wherein the signals stored in the memory are processed in a microcomputer so as to render them usable in a display system, said stored signals enabling the determination of the time of passing over the reference line of each of the moving objects.

2. An arrangement as set forth in claim 1 wherein each moving station includes a receiver adapted to receive the synchronization signal of period T, a binary counter controlled by said signal to enable said counter to count pulses furnished by a high frequency time base, a code generator the outputs of which are permanently in predetermined logic states corresponding to the rank of the signal of duration Tn and to the code assigned to said signal, said predetermined logic states being different for each of the moving stations, a comparator for comparing the outputs of the code generator to the outputs of the binary counter and furnishing a logic signal when such outputs are equal, a logic circuit responsive to the binary counter, the logic circuit having a first output for placing a transmitter in a state to broadcast over the time interval during which the comparator output furnishes said logic signal and a second output for providing, at least over said interval, logic states corresponding to the identification code of the mobile station under consideration, said logic states modulating the radioelectric signal broadcast by said transmitter.

3. An arrangement as set forth in claim 2 wherein the logic states modulating the radioelectric signal are defined by a signal of frequency f1 for the logic state 1 and by a signal of frequency f2 for the logic state 0.

4. An arrangement as set forth in claim 3 wherein $f2 = f1/2$.

5. An arrangement as set forth in claim 4 wherein f1 =9MHz.

6. An arrangement as set forth in claim 2 wherein the time base furnishes a frequency of 9MHz.

7. An arrangement as set forth in claim 2 wherein the signal of duration Tn includes the juxtaposition of twelve bits Tb the durations of which are equal, being in order of increasing times, two bits in state 0 during which the transmitter comes into operation, one bit in state 1 preceding the bits defining the moving station code, seven coding bits the states of which vary in accordance with the moving station under consideration, a parity bit serving as check and a bit in state 0 following which the transmitter is stopped.

8. An arrangement as set forth in claim 2 wherein the duration of each of the twelve bits Tb is equal to the period furnished by the high frequency time base which period is multiplied by $2^3$.

9. An arrangement as set forth in claim 7 wherein, if the frequency of the time base is equal to 9MHz the duration of each of the twelve bits Tb equals 888ns and the duration of the signal Tn equals 10.66 μs.

10. An arrangement as set forth in claim 2 wherein the signal of duration Tn broadcast by a predetermined moving station is separated from the signal of duration Tn broadcast by the immediately preceding or following station by a security period Ts with no broadcasting.

11. An arrangement as set forth in claim 1 wherein the fixed station includes a time base producing a high frequency signal, a frequency divider controlled by said high frequency signal in order to produce the low frequency synchronization signal of period T which in turn modulates the transmitter of the fixed station, an absolute time generator incremented by said signal of period T, a receiver adapted to receive the signals of duration Tn broadcast by the transmitters of the moving stations, an A/D converter the analog input of which takes into account the amplitude of the signals of duration Tn coming from the receiver, a binary counter controlled by said synchronization signal of period T which enables said counter to count the pulses furnished by said high frequency signal, a memory the inputs of which are connected to the respective outputs of the A/D converter, of the absolute time generator and of the binary counter, a shift register for sequentially storing the signals of duration Tn coming from the receiver, a comparator for comparing the outputs of the shift register to the outputs of the binary counter and for furnishing a logic signal when such outputs are equal, an operator responding to a plurality of predetermined logic equations, the inputs of said operator being connected to the outputs of the binary counter, a trigger circuit combining said logic signal with the operator outputs to produce a signal indicative of the correct acquisition of a signal of duration Tn and enabling such signal to be written into the memory according to a predetermined arrangement and a microcomputer for processing the signals of duration Tn stored in the memory and rendering them accessible to a user.

12. An arrangement as set forth in claim 11 wherein the time base furnishes a frequency of 9MHz.

13. An arrangement as set forth in claim 11 wherein the memory includes a network of intersecting lines and columns, a line being representative of the absolute time, a column being representative of all the signals of duration Tn broadcast by a same moving station and an item of data relative to the amplitude of a particular signal of duration Tn being located at the intersection of a line and of a column.

14. An arrangement for the identification of a plurality of moving objects and determination of the instant of their passing over a reference line, said arrangement comprising:

a fixed station including a first transmitter and a first receiver having an antenna located in the neighborhood of the reference line;

a plurality of moving stations, each moving station comprising a second receiver and an associated second transmitter mounted on a respective one of said moving objects;

means at said fixed station for energizing said first transmitter to transmit a synchronization signal having a period T to each of said second receivers;

first means at each of said moving stations responsive to the second receiver for causing the associated second transmitter to transmit to said first receiver a signal $Tn << T$ for a fixed interval of time during each period T, the fixed intervals of time being non-overlapping and, for each associated second transmitter, beginning at a different time relative to the beginning of said period T;

second means at said fixed station responsive to said first receiver for deriving from each signal Tn an indication of the second transmitter which transmitted it and the magnitude of the signal Tn as received by said first receiver; and, third means at said fixed station responsive to said second means for determining the time at which each of said moving objects passes over said reference line.

15. An arrangement as claimed in claim 14 wherein each said second transmitter includes means for transmitting a coded signal Tn different form the coded signals Tn transmitted by other second transmitters.

16. An arrangement as claimed in claim 15 wherein:

the means for energizing said first transmitter includes a timebase, and, said second means comprises a counter responsive to said time base for producing count signals, comparator means for comparing said coded signals with said count signals, analog to digital convertor means responsive to said first receiver means for producing a digital code representing the magnitude of a signal received by said receiver, and, means responsive to said comparator means for actuating said digital converter means when said comparator means determines that said coded signals equal said count signals.

17. An arrangement as claimed in claim 16 wherein said third means comprises a memory for storing digital codes produced by said analog to digital converter means, a time reference generator, and addressing means responsive to said time reference generator and said count signals for addressing said memory.

18. An arrangement as claimed in claim 17 wherein said addressing means includes a microprocessor unit.

19. An arrangement as claimed in claim 18 wherein said microprocessor unit includes means for determining from said stored digital codes the time at which each of said moving objects passes over said reference line.

20. An arrangement as claimed in claim 19 wherein said microprocessor unit includes a display means for displaying the identity of each moving object and the time at which each moving object passes over said reference line.

* * * * *